United States Patent [19]

Müller-Deisig et al.

[11] 4,032,190

[45] June 28, 1977

[54] ERGONOMICALLY DESIGNED CHAIR

[75] Inventors: Wolfgang Müller-Deisig, Schieder-Schwalenberg; Egon Bräuning, Weil am Rhine, both of Germany

[73] Assignee: Fehlbaum, Basel, Switzerland

[22] Filed: June 7, 1976

[21] Appl. No.: 693,610

[30] Foreign Application Priority Data

June 13, 1975 Switzerland ..... 7721/75

[52] U.S. Cl. ..... 297/353; D6/30; 297/300

[51] Int. Cl.[2] ..... A47C 3/00

[58] Field of Search ..... 297/299, 300, 354, 296, 297/297, 298, DIG. 2, 353, 457; D6/26, 30, 31

[56] References Cited

UNITED STATES PATENTS

| | | | |
|---|---|---|---|
| 2,667,210 | 1/1954 | Eames | 297/297 |
| 2,731,078 | 1/1956 | Cadman et al. | 297/DIG. 2 |
| 3,133,765 | 5/1964 | Kramer | 297/457 X |
| 3,309,136 | 3/1967 | Kehoe | 297/296 |
| 3,866,974 | 2/1975 | Jones | 297/353 |
| 3,883,176 | 5/1975 | Morton | 297/457 |

FOREIGN PATENTS OR APPLICATIONS

| | | | |
|---|---|---|---|
| 228,386 | 3/1960 | Australia | 297/390 |

*Primary Examiner*—James T. McCall
*Attorney, Agent, or Firm*—Ladas, Parry, von Gehr, Goldsmith & Deschamps

[57] ABSTRACT

The chair has a back rest provided with stiffening means which impart to the back rest a substantially stiff form up to about the level of the sixth lumbar vertebra of the chair occupant, thus ensuring a continuous transition from the chair seat to the back rest, but allow the back rest an increasingly greater flexibility from said level upwards with the result that the upper part of the back rest bends backwards when the occupant leans back, further characterized in that the upper end of the back rest is joined to the shoulder rest via a bracing corrugation in order to ensure that the chair profile in the region of the occupant's shoulder is a smooth curve matching that of the occupant's spine.

6 Claims, 3 Drawing Figures

ERGONOMICALLY DESIGNED CHAIR

This invention relates to an ergonomically designed chair with a rigidly mounted seat, a back rest joined to the chair seat and a shoulder rest joined to the upper end of the back rest.

To ensure ergonomically correct support of a chair occupant's lower back, it is necessary to provide between the chair seat and back rest a link which is able to adapt as accurately as possible to the natural positions of the human body. To this end, a number of constructions have already been suggested which enable the inclination of the chair back relative to the chair seat to be adjusted by a lever mechanism. Such constructions are as a rule intricate and correspondingly expensive, and are only suitable for use where their other advantages such as the adjustment of the chair seat inclination are of importance. Such refinements are not required however of chairs which are intended for use in rows of seating or for applications requiring individual seating not of a particularly high standard, e.g. for seating at tables, but which should nevertheless seat the occupant comfortably. Anatomically correct support of the buttocks and the lower region of the spine is of particular importance where people have to sit practically motionless for long periods, e.g. in lecture and concert halls.

The aim of the present invention is therefore to propose a chair of the kind outlined at the outset which can be manufactured simply and cheaply and satisfies the requirements necessary for the reliable support of the lower part of the spine in particular.

The chair of the invention is characterized in that the back rest is provided with stiffening means which impart to the back rest a substantially stiff form up to about the level of the sixth lumbar vertebra of the chair occupant, thus ensuring a continuous transition from the chair seat to the back rest, but allow the back rest an increasingly greater flexibility from said level upwards with the result that the upper part of the back rest bends backwards when the occupant leans back, further characterized in that the upper end of the back rest is joined to the shoulder rest via a bracing corrugation in order to ensure that the chair profile in the region of the occupant's shoulders is a smooth curve matching that of the occupant's spine.

Figure 1:
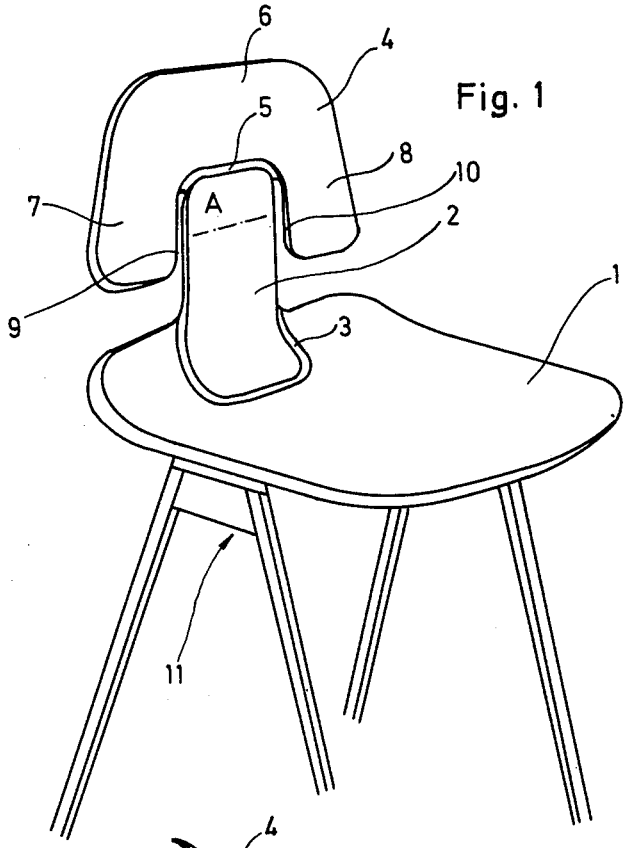
Figure 2:
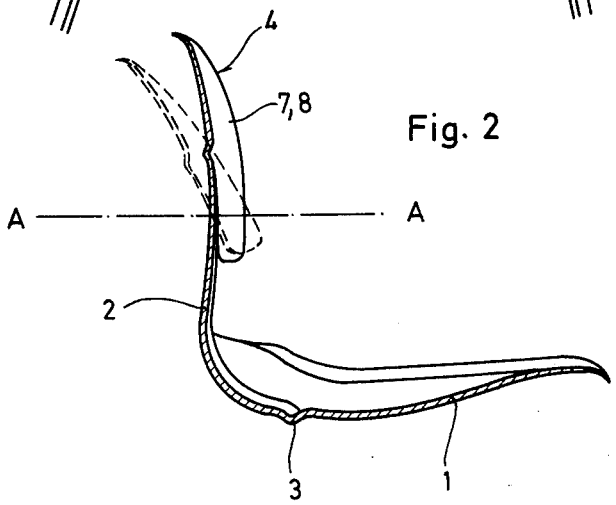
Figure 3:
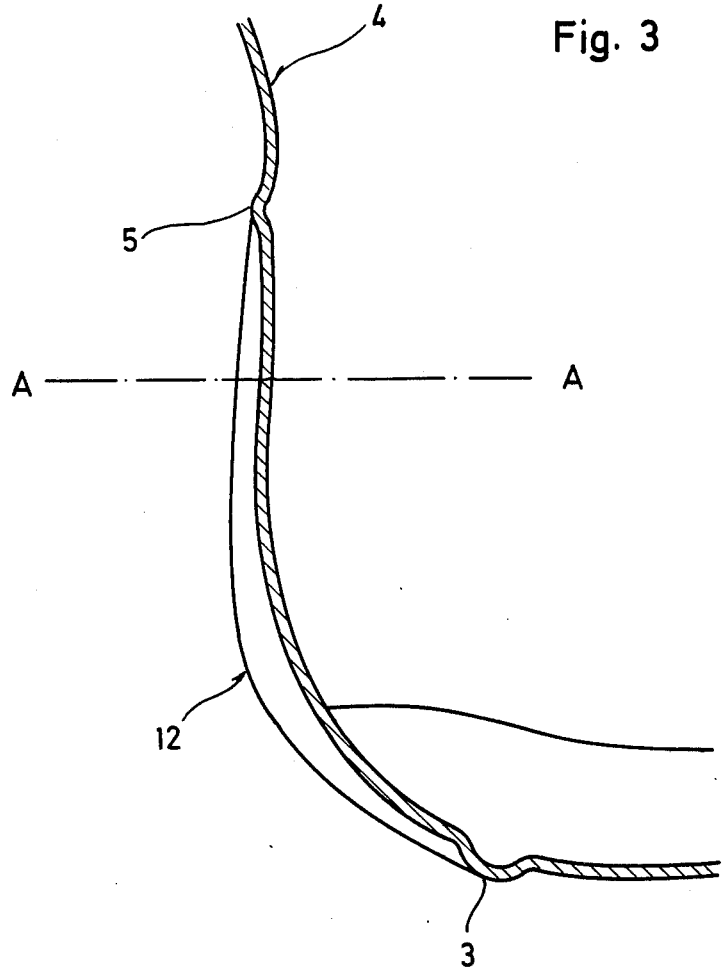

An illustratory embodiment of the invention is described below in conjunction with the Drawing in which FIG. 1 shows a perspective and in places simplified view of a chair in accordance with the invention, FIG. 2 shows a section along the plane of symmetry of the chair of FIG. 1 and FIG. 3 shows on a larger scale the back rest between the chair seat and where the back rest joins the shoulder rest.

FIGS. 1 and 2 depict a conventional seat plate 1, the shape of which matches the natural contours of the occupant's buttocks and thighs as well as possible in order to ensure that the occupant is comfortable. The seat plate is made of plastic with or without glass fibre reinforcement and can be upholstered to improve comfort. At the centre of the rear of the seat plate 1 a back rest 2 is molded on. The back rest 2 is integrally joined to the seat plate 1 along a corrugation 3 which imparts a high degree of stiffness to the region where the seat plate and back rest join. The corrugation 3 follows a substantially U-shaped course and, as can best be seen from FIG. 2, extends on both sides and along the lower edge of the back rest practically to the lowest point of the seat plate. The seat plate, already quite stiff in the buttocks region as a result of its design shape, is thus further reinforced, resulting in a join between back rest and seat plate which hardly deforms when the chair is used.

A shoulder rest 4 is molded onto the upper end of the back rest 2 along a corrugation 5. The shoulder rest 4 comprises a central section 6 bordered on each side by wings 7 and 8 respectively. Each wing is separated from the back rest 2 by a gap 9, 10, the gaps extending up to the ends of the corrugation 5. By virtue of the joins made by corrugations 3 and 5 between the seat plate 1, the back rest 2 and the shoulder rest 4, the chair possesses an integral seat and back section which can be manufactured from the same material and in a single operation. This seat and back section can for instance be fixed to legs or a pedestal 11 with three or four screws or rivets in almost any way required. If necessary, arm rests (not shown) can be mounted on the seat plate or on the legs or pedestal 11.

The ergonomic properties of the chair result from the special design of the part of the chair back projecting above the seat plate 1. It is essential for the back rest 2 and the central section 6 of the shoulder rest 4 to be able to bend when the chair occupant leans back and still match the natural profile of the spine as exactly as possible. Since, even with people of various heights, the distance between the buttocks and the sixth lumbar vertebra is approximately the same, varying by only 2–3 cm, it is possible to design the chair back so that, when the back rest and central section of the shoulder rest are bent backwards, their profile remains a smooth curve which matches that of any occupant's spine. The bending of the chair back is controlled by reinforcing ribs 12 preferably running along at the sides of the back rest 2 as shown in FIG. 3, the thickness of the ribs 12 being chosen so that when the occupant leans back the part of the chair back below the line A (FIG. 1) or A—A (FIGS. 2 and 3) only bends slightly. Above this line the thickness of the reinforcing ribs progressively decreases, reaching the value zero at the corrugation 5. This corrugation 5 extends across the whole width of the back rest 2 and acts a a kind of hinge about which the shoulder rest can be tilted without any particular effort by the pressure of the chair occupant's shoulder blades, thus adjusting to the posture of the occupant's body. At the same time the wings 7 and 8 tilt forwards somewhat owing to the gaps 9 and 10 between the back rest and the wings 7, 8 on each side of the shoulder rest, thus supporting the lumbar region of the back which also tilts forwards somewhat when the shoulders are leant back.

We claim:

1. An ergonomically designed chair comprising a rigidly mounted seat, a back rest integrally joined to the seat and a shoulder rest integrally joined to the upper end of the back rest, the profile of the central region of the back rest substantially matching the curve of the human spine, wherein the back rest is joined to the seat by means of a portion of the back rest which fits into a region at the rear center of the seat and at least said portion of the back rest is provided with stiffening means which impart to the back rest a substantially stiff form up to about the level of the sixth lumbar vertebra of the chair occupant, thus ensuring a continuous transition from the chair seat to the back rest, but allow the back rest an increasingly greater flexibility from said level upwards with the result that the upper part of the back rest bends backwards when the occupant leans back, and wherein the upper end of the back rest is joined to the shoulder rest via a bracing corrugation in order to ensure that the chair profile in the region of the occupant's shoulders is a smooth curve matching that of the occupant's spine.

2. The chair of claim 1, wherein the lower end of the back rest fits into a gap in the rear section of the chair seat and is joined to the chair seat by another bracing corrugation.

3. The chair of claim 1, wherein the shoulder rest includes lateral wings which extend downwards from the level of the join between the back rest and the shoulder rest, are each separated from the back rest by a gap and can pivot together with the upper part of the shoulder rest about said bracing corrugation which acts as a hinge.

4. The chair of claim 1, wherein the chair seat, the back rest and the shoulder rest are molded in one piece.

5. The chair of claim 2, wherein the gap in the rear section of the chair seat is U-shaped.

6. The chair of claim 2, wherein the bracing corrugation joining the back rest to the chair is U-shaped.

* * * * *